United States Patent [19]

Nakaoka

[11] 3,953,943

[45] May 4, 1976

[54] APPARATUS FOR AUTOMATICALLY DETECTING AND ELIMINATING FLAWS ON SLABS OR BILLETS

[75] Inventor: Eiichi Nakaoka, Kyoto, Japan

[73] Assignee: Shimadzu Seisakusho Ltd., Kyoto, Japan

[22] Filed: Feb. 27, 1975

[21] Appl. No.: 553,639

[52] U.S. Cl. ..... 51/34 E; 51/165.74; 51/165.92; 51/327

[51] Int. Cl.[2] ..... B24B 49/00

[58] Field of Search ..... 51/34 R, 34 E, 35, 59 R, 51/60, 165 R, 165.74, 165.72, 165.92, 327, 281 R; 83/371; 144/310 B, 310 R

[56] References Cited

UNITED STATES PATENTS

| | | | |
|---|---|---|---|
| 3,052,067 | 9/1962 | Dilks | 51/35 |
| 3,547,170 | 12/1970 | Maxey | 83/371 X |
| 3,681,877 | 8/1972 | Shively | 51/281 R X |
| 3,760,667 | 9/1973 | Maxey | 83/371 X |
| 3,774,353 | 11/1973 | Yasunaga | 51/322 |
| 3,813,973 | 6/1974 | Goodchild | 83/371 X |

*Primary Examiner*—James L. Jones, Jr.
*Assistant Examiner*—Robert C. Watson
*Attorney, Agent, or Firm*—Fidelman, Wolffe & Waldron

[57] ABSTRACT

Apparatus for automatically detecting and eliminating flaws on slabs or billets which comprises a flaw detector and a grinder both mounted on a common carriage reciprocable alongside the slab or billet under inspection. The detector and the grinder are movable relative to the carriage and consequently the object under inspection so that as the carriage reciprocates, the detector scans the surface of the slab or billet, with the grinder following the scanning locus of the detector a predetermined distance behind on the scanning line, ready to eliminate the flaw detected by the detector.

4 Claims, 7 Drawing Figures

APPARATUS FOR AUTOMATICALLY DETECTING AND ELIMINATING FLAWS ON SLABS OR BILLETS

This invention relates to an apparatus for automatically detecting and eliminating defects or flaws on or in the surface of an object such as an iron or steel plate commonly called a slab or an iron or steel bar commonly called a billet having a square or rectangular cross-section.

Detection and subsequent elimination of defects or flaws in slabs or billets are essential for supervision of the quality of the iron and steel products. There are known various methods of detecting and removing such defects from the material, most of which are carried out manually by workers. That is, they visually inspect the surface of the slab or billet and put a marking on any defect they have detected on the surface thereof and mannually apply a portable grinder onto the marked defect to grind it off from the surface of the slab or billet.

There are, however, many problems encountered in the prior art methods. One is that the working efficiency is very low. That is because detection and subsequent removal of defects are conducted separately with the eye and by the hand of the worker.

Another problem is that the accuracy of detection of defects and that of elimination of the defects are very low. The accuracy with which the detection is conducted depends upon the eye and skill of the worker and therefore varies with different workers. It is possible with the naked eye to detect only those flaws which exist on the surface of the slab and not those flaws hidden under the surface thereof. The accuracy with which the elimination of the detected flaws is effected also varies with different workers having different degrees of skill, with the result that the quality of the finished products becomes uncertain.

A third problem is the physical and mental fatigue of the workers. Visual inspection causes severe fatigue to the eye of the worker. Even with the use of a flaw detector, manual operation of a grinder to remove the flaw causes much physical fatigue to the worker. Moreover, the iron particles or dust ground off from the slab or billet do harm to the respiratory organs of the worker.

Accordingly, it is one object of the invention to provide an apparatus for detecting defects or flaws on slabs, billets and the like and eliminating the flaws, wherein the detection and subsequent elimination of flaws are automated so that the above-mentioned problems of the prior art methods have been completely solved. The apparatus of the invention is provided with a flaw detector and a flaw eliminator or grinder so arranged that upon detection of a flaw on the object under inspection the detector produces a detection signal to control the eliminator so as to eliminate the detected flaw.

Another object of the invention is to provide such an apparatus as aforesaid, wherein the detector and the grinder operate simultaneously so that detection of flaws and elimination thereof are automatically conducted in parallel and continuously, thereby improving the working speed and efficiency.

Still another object of the invention is to provide such an apparatus as aforesaid, wherein the detector scans the surface of the object under inspection and the eliminator follows the scanning locus of the detector a predetermined distance behind on the locus so as to enable accurate elimination of the flaw that has been detected by the detector.

A further object of the invention is to provide such an apparatus as aforesaid, wherein the detector has a detecting head which is so designed as to ensure a close and exact contact between the head and the surface under inspection despite the irregularity or ruggedness of the surface, thereby improving the accuracy of detection of flaws on the surface.

The invention with its above and other objects will be more clearly understood from the following description of preferred embodiments thereof with reference to the accompanying drawings, wherein.

Broadly, the automatic flaw detecting and eliminating apparatus constructed in accordance with the invention is provided with a flaw detector and a flaw eliminator both mounted on a common carriage reciprocable alongside the length of an object to be inspected. The detector and the eliminator are movable relative to the carriage and consequently the object under inspection so that as the carriage reciprocates, the detector scans the surface of the objects, with the eliminator following the scanning locus of the detector a predetermined distance behind on the scanning line, ready to eliminate the flaw detected by the detector.

Figure 1:
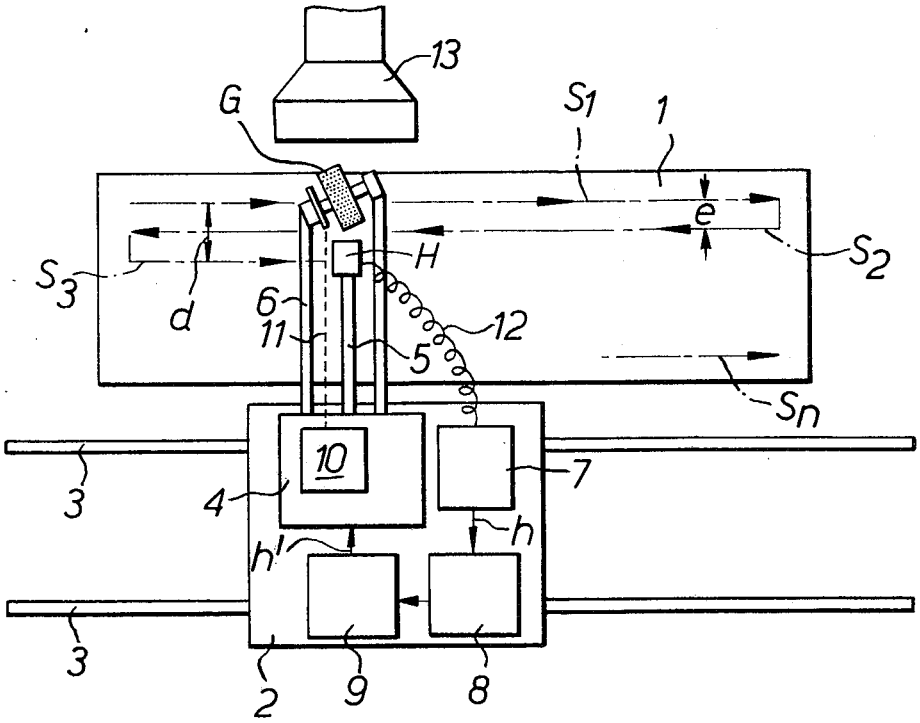
FIG. 1 is a top plan view showing the general layout of the automatic flaw detecting and eliminating apparatus constructed in accordance with the invention.

Now referring in detail to the drawings, first to FIG. 1, there is shown a slab 1 the defects or flaws of which are to be detected and eliminated. The slab is, for example, 1 meter wide, 15 cm thick and 10 meter long and is fixed in position by any suitable known means not shown while the machine of the invention is operating in the manner to be described hereinafter.

Alongside the slab a carriage 2 is reciprocable on a pair of rails 3 and 3. A detecting head H is carried on the carriage 2 by means of a support arm 6. A mechanism 4 moves both the head H and the grinder G over the upper surface of the slab transversely thereof. The mechanism 4 includes a drive screw rod, a hydraulic or pneumatic drive, a cam and lever mechanism, etc.

The arms 5 and 6 are simultaneously moved across the slab with a predetermined fixed distance *d* being maintained between the head H and the grinder G. Since the carriage moves alongside the slab, the head and the grinder are moved over the slab longitudinally thereof.

The mechanism 4 operates in association with the reciprocating movement of the carriage 2 in such a way that when the carriage has finished its travel from one to the opposite end of the slab longitudinally thereof, the head H and the grinder G are displaced by a predetermined pitch *e* relative to the slab. With this arrangement the head H is able to scan the whole surface area of the slab along a locus designated by the dot-and-dash line in FIG. 1.

Suppose that the distance $d$ is equal to double the pitch $e$, that is, $d=2e$. If the head H is now on the third scanning line S3 from one lateral side of the slab (the upper side thereof as viewed in FIG. 1), the grinder G is scanning the first line S1.

The distance $d$ may be zero, that is, the arms 5 and 6 may be of the same length so that the head H and the grinder G may be arranged side by side on one and the same scanning line. The pitch $e$ is determined in accordance with the required flaw detecting width.

In the illustrated embodiment, between the head H and the grinder G a delay exists corresponding to the time required for one reciprocation of the carriage along the length of the slab 1. In other words, the grinder G is behind the head on the scanning locus by a distance corresponding to one reciprocation of the carriage along the length of the slab.

The head H is connected through a line 12 to a detector 7, which produces a detection signal $h$ when the head H has detected a flaw on the slab. The detection signal $h$ is applied through a delay means 8 to a controller 9. The delay time set by the means 8 is equal to the time required for one reciprocation of the carriage. When the delay time has passed after receipt of the signal $h$, the controller 9 produces a signal $h'$ to actuate the mechanism 4 and a drive motor 10 so that the grinder G now positioned on the flaw that has been detected by the head H grinds the flaw off the slab surface. A belt 11 connects the motor and the grinder and a duct 13 collects and discharges iron particles or dust ground off from the slab.

So long as the carriage is moved at a constant scanning speed, the delay time set by the delay means 8 may be fixed. However, if the scanning speed is variable, the delay time must be varied accordingly.

Figure 3:
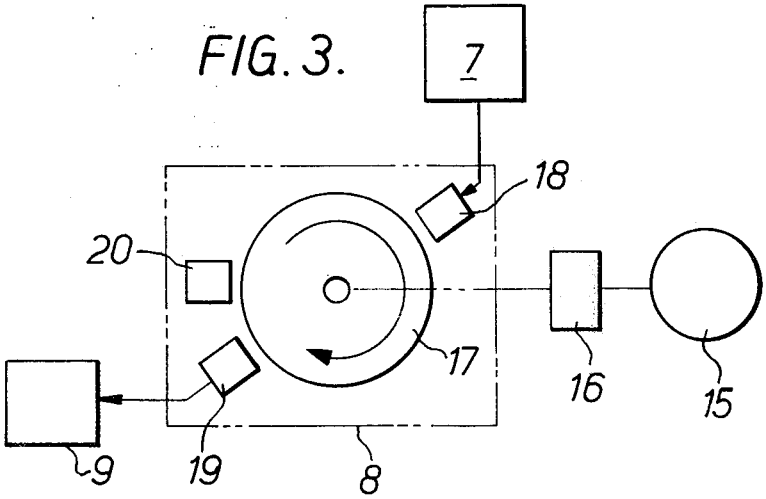
FIG. 3 is a block diagram of one component part of the apparatus of the invention.

FIG. 3 shows the delay means 8 in detail. A magnetic drum 17 is rotated in the direction of the arrow in synchronism with the movement of the carriage 2. As the carriage reciprocates, the drum is rotated for an angle corresponding to the distance that has been travelled by the carriage. A recording or writing head 8 receives the signal $h$ from the detecting head 7 and magnetically records it on the drum. A motor 15 rotates the drum through the intermediary of a clutch 16. A reproducing head 19 reads the signal previously written on the drum by the writing head. As can be easily seen, a delay time is provided by the time required for the position on the drum where the signal $h$ has been recorded by the writing head 18 to come around as far as the reading head 19. An erasing head 20 erases the signal $h$ after the reading head 19.

Since the grinder G is moved from one to the opposite ends of the slab, the preceding head H runs over the opposite edges of the slab and produces a detection signal which must be erased by any suitable means not shown in FIG. 3.

The machine of the invention may employ any other delay means than that shown in FIG. 3. A purely mechanical device may be employed for the purpose.

FIG. 1 shows the general layout of the machine of the invention, which will be described in further detail with reference to FIG. 2. The same reference symbols and numerals denote corresponding parts in FIGS. 1 and 2.

The arms 5 and 6 supporting the head H and the grinder G, respectively, are not directly mounted on the carriage 2 but on a slide or base 30, which is slidable on the carriage in a direction perpendicular to that of the reciprocating movement of the carriage. Strictly, the arm 6 for the grinder G is mounted on a lifting member 31 which is guided by a guide frame 32 fixed to the slide so that the arm is vertically movable relative to the slide and consequently the grinder can selectively be brought into and out of contact witch the upper surface of the slab under inspection.

The motor 10 is mounted on the lift 31 and has a pulley 36 fixed to the output shaft thereof. The belt 11 connects the pulley 36 and the grinder. A timer 39 controls the time for which the motor is energized, so that the grinder is rotated for a predetermined period of time to grind the flaw or scar off the slab.

The vertical movement of the lifting member 31 is effected by any suitable device. In the illustrated embodiment, a motor 25 transfers its output through a clutch 34 to a lifting device 33 which may comprise a feed screw rod as a chief element so as to lift or lower the member 31. The vertical distance the member 31 is moved is detected by a detector 35.

When the member 31 is lowered, the detector 35 produces a signal upon contact of the grinder G on the upper surface of the slab 1. The signal is applied to the clutch 34 and the timer 39 so that the downward movement of the member 31 is stopped and at the same time the grinder is rotated. When the member 31 is raised, the detector 35 produces a signal when the member 31 has reached a position above the slab surface. The signal is applied to the clutch 34 to stop the member 31 but not to the timer 39.

The reason why the grinder is lowered into contact with the surface of the slab only when grinding is to be conducted is that while the head is scanning the slab surface in sliding contact therewith, any contact between the grinder and the slab surface must be avoided.

As previously mentioned, the slide 30 is movable on the carriage transverely thereof, that is, in a direction perpendicular to the direction of movement of the carriage on the rails. A pair of rails 37 guide the slide as it is moved in the above manner by means of a feed screw rod 29 which engages with the slide 30. The transverse movement of the slide 30 with the detecting head and the grinder thereon is effected intermittently at the opposite ends of each scanning line S1, S2 . . . in order that the head and the grinder change from one to the next of the scanning lines at each end of the length of the slab. To this end a motor 23 rotates the screw rod 29 through a clutch 22. The clutch is controlled by a sequence circuit 21 so as to transmit the rotation of the motor 23 to the screw rod 29 thereby to move the slide 30 and consequently the head H and grinder G in the direction perpendicular to the length of the slab.

The reciprocating movement of the carriage along the length of the slab is effected by a reversible motor 24 mounted on the carriage. The motor 24 rotates a pinion 27 which engages a rack 28 extending alongside the rails 3. A bearing 2' journals the shaft of the pinion 27. A clutch 26 controlled in the manner to be described hereinafter controls transmission of the rotation of the output shaft of the motor 24 to the pinion 27.

A controller 9' receives the signal from the previously mentioned reading head 19 which has read the signal from the drum 17 and applies a corresponding signal to the clutches 16, 26 and 34 and also to the sequence circuit 21. When the signal is applied to the clutches 16 and 26, the drive connection between the motor 24 and the pinion 27 and that between the motor 15 and the drum 17 are interrupted.

When a start switch 14 is operated, a signal is applied to the clutches 16 and 26 to establish the drive connection between the motor 15 and the drum 17 and that between the motor 24 and the pinion.

The switch 14 is so designed that upon completion of the grinding operation, the timer 39 applies a signal to the switch, which automatically produces a start signal.

In operation, a slab 1 is fixed in work position and the carriage is moved on the rails so that the detecting head is positioned at one end (the left-hand end in FIG. 1) of the first scanning line S1.

Then the start switch 14 is pressed, whereupon a signal is applied to the detector 7, the clutches 16 and 26 and the sequence circuit 21. The carriage 2 starts moving rightward with the head H scanning the slab surface for any flaws or defects. At the same time, the magnetic drum 17 starts its rotation in accordance with the running speed of the carriage 2. The sequence circuit 21 intermittently applies a signal to the clutch 22, so that each time the head H has arrived at each of the opposite ends of the slab, the slide 30 is moved by one pitch *e* transversely of the slab so that the head H changes from the scanning line it has been following to the next scanning line, whereupon the motor 24 is rotated in the opposite direction so that the carriage is moved in the opposite direction. The grinder G is moved together with the head and as can be easily seen from FIG. 1, the grinder G is behind the head H by a distance corresponding to just one reciprocation of the head H as viewed along the scanning locus thereof.

Suppose now that a defect or flaw has been detected by the head H. The detector 7 produces a signal *h*, which the writing head 18 magnetically records on the surface of the drum 17. The head is farther moved and when it has completed one reciprocation along the length of the slab, the grinder G has reached where the flaw was previously detected by the head.

Since the drum 17 is also being rotated, the signal *h* reads the recorded signal and applies a corresponding signal to the controller 9'. Then the controller applies a signal to the clutches 16 and 26 thereby to temporarily stop the drum 17 and the pinion 27 and consequently the carriage, with the grinder having been positioned above the previously detected flaw on the slab.

The controller 9' applies a signal also to the clutch 34 thereby to cause the lifting member 31 to lower as far down as the grinder G touches the upper surface of the slab where the flaw is.

The detector 35 detects that the grinder G has touched the flaw and produces a signal to be applied to the clutch 34 to stop the lowering of the member 31. The signal from the detector 35 is also applied to the timer 39 to energize the motor 10 for a preset period of time. The motor 10 rotates the grinder G to perform grinding operation on the flaw.

When the flaw has been completely removed, the timer 39 applies a signal to the clutch 34 and the motor 25 is rotated in the opposite direction to raise the member 31 and stop it at the original position, whereupon the detector 35 applies a signal to the switch 14 so that the above operation is started again.

The record on the drum 17 is erased by an erasing head 20 after the grinding operation has been finished in the above manner.

Figure 2:
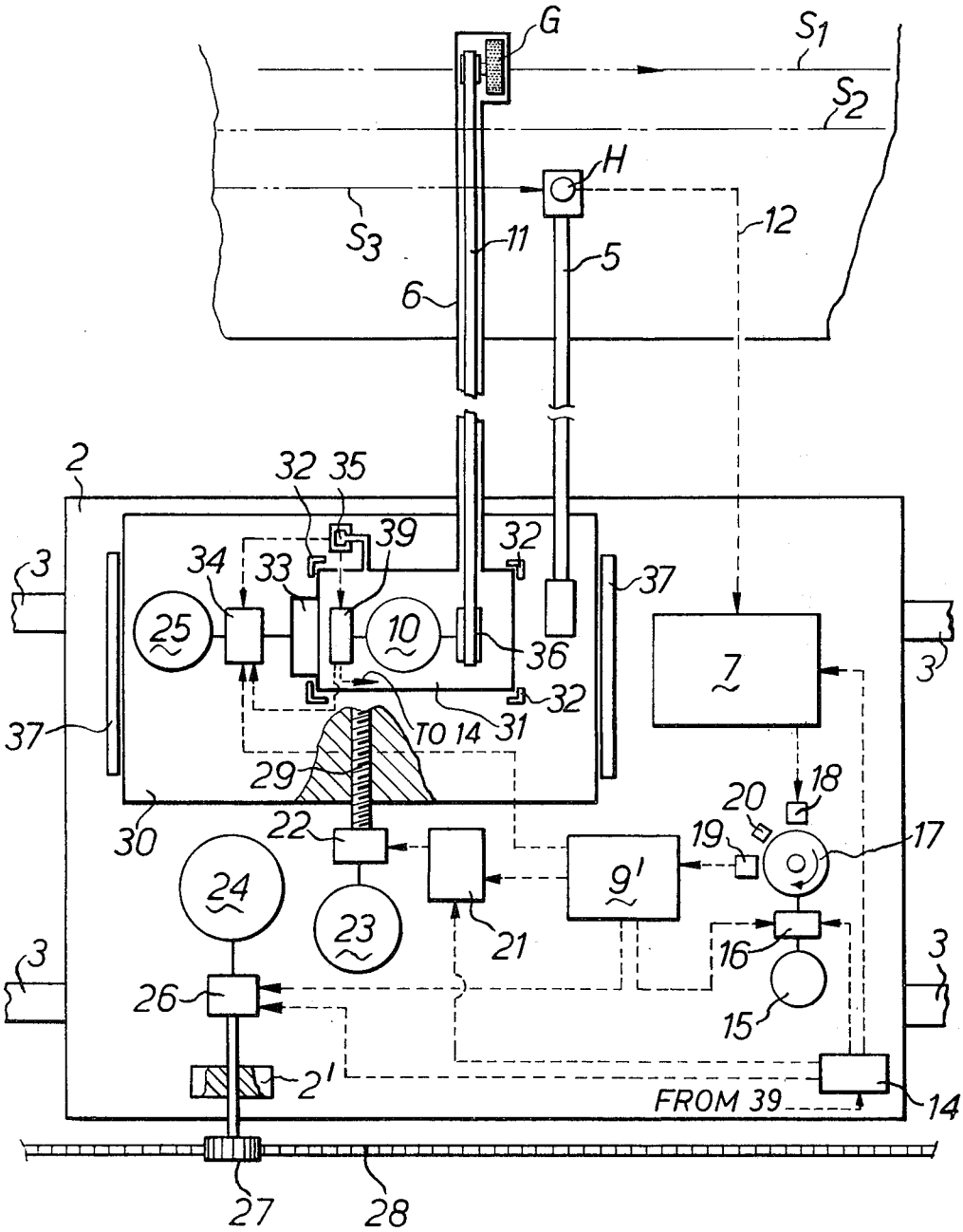
FIG. 2 is a view similar to FIG. 1 showing the construction of the apparatus in further detail.
Figure 4:
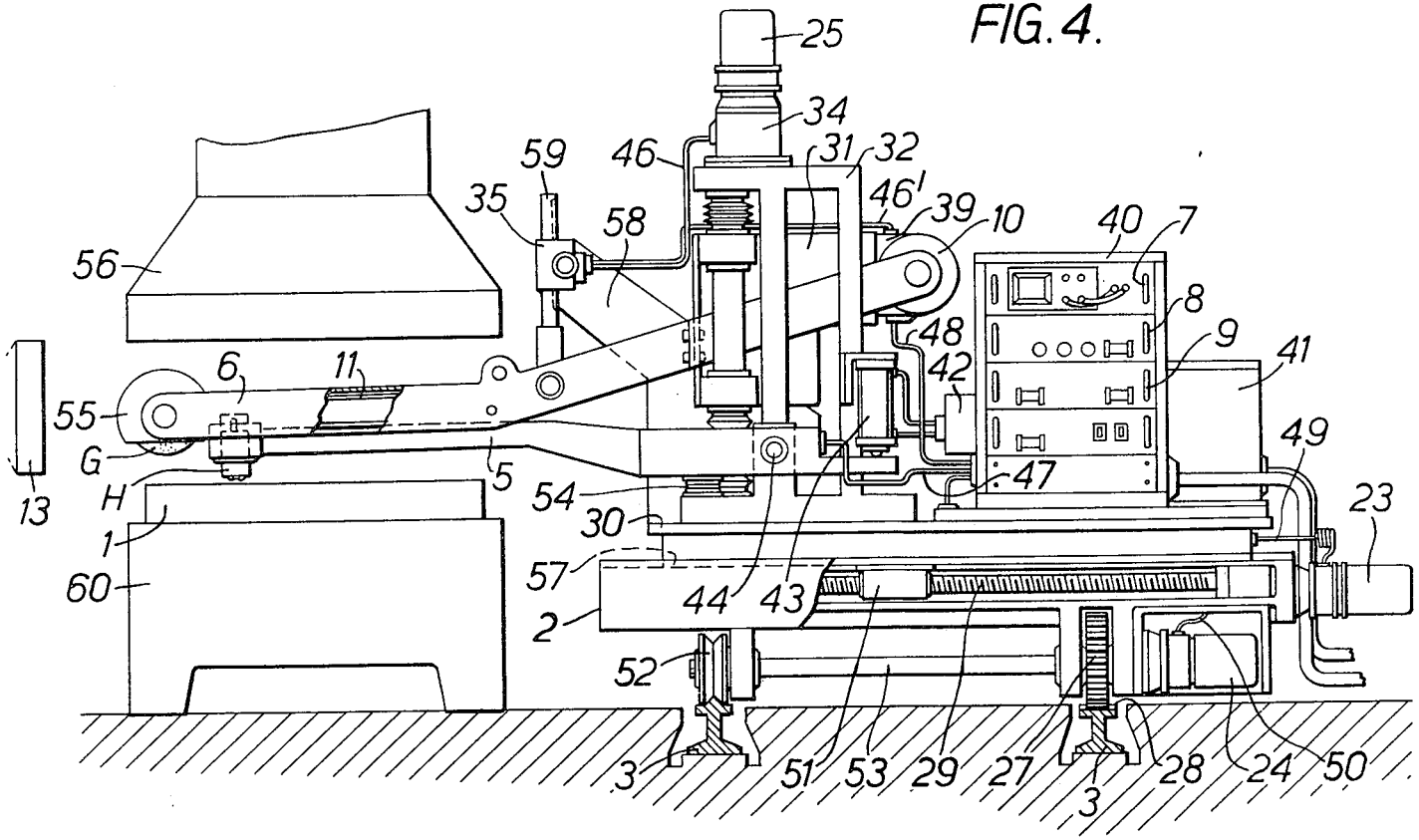
FIG. 4 is a side view of a machine constructed in accordance with the invention.

FIG. 4 shows a concrete arrangement of the machine shown in FIGS. 1 to 3. In FIG. 4 the same reference symbols and numerals as in FIGS. 1 to 3 designate corresponding parts which will not be explained in the following.

As previously mentioned, the slide 30 is moved relative to the carriage by means of the screw rod 29, which is threaded through a nut 51 fixed to the slide 30. The relative movement of the base is guided by a dovetail grove 57.

The rack 28 is formed on one of the rails 3, with the pinion 27 engaging the rack. The other rail 3 has a mountain-shaped cross-section, with a roller 52 having a V-shaped groove engaging the rail so as to prevent lateral vibration of the carriage 2.

The roller 52 and the pinion 27 are fixed to an axle 53, to which the rotation of the reversible motor 24 is transmitted through a reduction gear.

The rotation of the reversible motor 23 is transmitted to the screw rod 29 also through a reduction gear. The reversible motor 25 is mounted on the guide frame 32. A casing 45 encloses the lifting device 33 which may comprise a screw rod rotated by the motor 25 and a nut secured to the member 31 and engaged by the screw rod.

The position detector 35 is supported by an arm 58 fixed to the slide 30, and a vertical rod 59 fixed to the support arm 6 of the grinder G is movable relative to the detector 35 so that displacement of the rod 59 is detected by the detector 35. The arm 6 of the grinder is fixed to the member 31 and encloses therein the belt 11 for transmitting the rotation of the motor 10 to the grinder.

The support arm 5 of the detecting head H is pivoted at 44 to the lower portion of the guide frame 32, so that when the slab 1 is placed on a work table 60, the head H may be raised to get out of the way. This raising of the head H is effected by an air cylinder 43.

The reference numerals 46, 46', 47, 48, 49 and 50 designate electrical lead lines for transmitting signals to the motors, the clutches, etc.

The reference numeral 40 designates a control console which comprises the flaw detector 7 (e.g. of the eddy current type), the delay means 8 and the controller 9. A power source 41 and a compressor 42 with control valves are also provided on the carriage 2. In addition to the lateral duct 13 (FIG. 1), another duct 51 is disposed over the slab to collect the particles ground off from the slab.

Figure 5A:
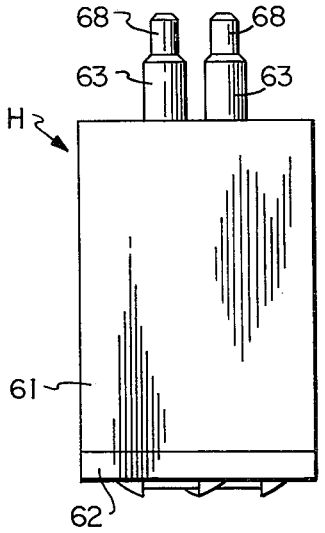
FIGS. 5*a*, 5*b* and 5*c* are front, sectional and bottom views, respectively, of one embodiment of the detecting head employed in the apparatus of the invention.
Figure 5B:
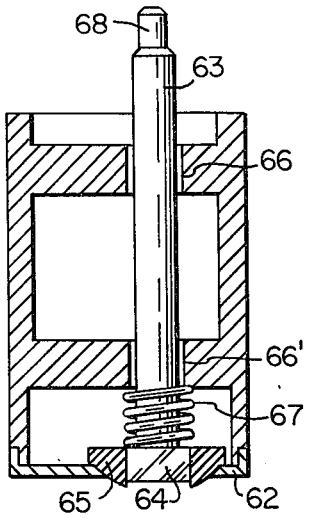
Figure 5C:
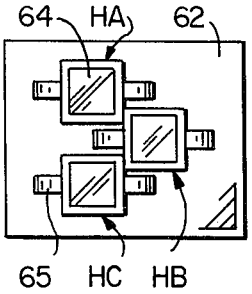

The surface of the slab or billet to be examined by the machine of the invention is irregular or rugged. Therefore it is required that the detecting head should be able to smoothly and accurately scan the irregular surface of the slab. FIG. 5 shows an arrangement to meet the requirement. The illustrated detecting head is of the eddy current type, but any other type may also be employed in the machine of the invention.

There are shown three detecting units HA, HB and HC which are held by a common frame or casing 61. Each of the units comprises a hollow rod 63, a detecting coil 64 attached to the lower end of the rod and a protective shoe 65 made of a suitable hard metal. Lead lines not shown but passing through the hollow rod 63 has its one end connected to the coil 64 and its opposite end connected to a connector 68 on the top end of the rod 63. A plug not shown but connected to the lead line 12 from the detector 7 is connectable to the connector 68.

The under portion of the shoe 65 projects downwardly from the bottom wall 27 of the casing 61 so that the under surface of the shoe 65 may contact the upper surface of the slab. The casing 61 is provided with upper and lower guide holes 66, 66' through which the hollow rod 63 is inserted, with a compression coil spring 67 urging the shoe 65 downwardly.

In the illustrated embodiment, three detecting units are provided so as to improve the accuracy of detection, but there are cases where a single detecting unit may suffice.

When the head H is in contact with the upper surface of the slab, the shoes 65 are slightly pressed against the slab surface, with the spring 67 being slightly compressed. Under this condition, as the head is moved for scanning the slab surface, the three detecting units are independently and separately moved up and down against the force of the spring in accordance with the irregularity of the slab surface, thereby ensuring a closer sliding contact of the shoe with the slab surface.

The compression spring may be replaced by any other suitable means. Gravity may also be utilized for the purpose without any positive urging means.

The machine of the invention has the following advantages. The use of the machine greatly improves the efficiency of flaw detecting and eliminating operation because of the effective combination of flaw detection and elimination. It also greatly heightens the accuracy of the detection and elimination with resulting improvement in the quality of the finished products. Furthermore it alleviates physical and mental fatigue of the workers.

What I claim is:

1. Apparatus for detecting defects on an object such as a slab or billet having a generally flat surface and eliminating said defects, comprising:

means for detecting a defect on or in said surface;

means for eliminating said defect detected by said detecting means;

a carriage reciprocable alongside said object, said detecting means and said eliminating means being mounted on said carriage in a predetermined positional relation relative to each other;

first moving means for moving said carriage relative to said object so that said detecting means scans said surface, with said eliminating means following said detecting means a predetermined distance behind along the scanning locus of said detecting means;

second moving means for moving said detecting means and said eliminating means relative to said carriage and across said object transversely of the direction of reciprocation of said carriage; and control means operable in response to said detecting means to operate said eliminating means to eliminate said defect previously detected by said detecting means.

2. The apparatus of claim 1, wherein said second moving means comprises a single slide member carrying thereon both said detecting means and eliminating means and being mounted on said carriage so that said slide member is movable relative to said carriage transversely of the direction of reciprocation thereof; and means for moving said slide member.

3. Apparatus for detecting defects on an object such as a slab or billet having a generally flat surface and eliminating said defects, comprising:

means for detecting a defect on or in said surface and producing a detection signal whenever a defect has been detected;

means for eliminating said defect detected by said detecting means;

means for supporting said detecting means and said eliminating means in a predetermined positional relation relative to each other;

first moving means for moving said supporting means relative to said object so that said detecting means scans said surface, with said eliminating means following said detecting means a predetermined distance behind along the scanning locus of said detecting means; and control means operable in response to said detecting means to operate said eliminating means to eliminate said defect previously detected by said detecting means;

said control means includes a magnetic drum, means for causing said signal to be temporarily recorded on said drum, and means for reading said recorded signal after a predetermined period of time corresponding to said predetermined distance along said scanning locus and applying said read signal to said eliminating means to actuate the same.

4. Apparatus for detecting defects on an object such as a slab or billet having a generally flat surface and eliminating said defects, comprising:

means for detecting a defect on or in said surface including a plurality of detecting units, means for holding said detecting units so that they are individually displaceable, relative to said holding means, and means for individually yieldably urging said detecting units against the surface of said object;

means for eliminating said defect detected by said detecting means;

means for supporting said detecting means and said eliminating means in a predetermined positional relation relative to each other;

first moving means for moving said supporting means relative to said object so that said detecting means scans said surface, with said eliminating means following said detecting means a predetermined distance behind along the scanning locus of said detecting means; and control means operable in response to said detecting means to operate said eliminating means to eliminate said defect previously detected by said detecting means.

* * * * *